US005749570A

United States Patent [19]

Iwata et al.

[11] Patent Number: 5,749,570

[45] Date of Patent: May 12, 1998

[54] SHEET CONVEYING APPARATUS

[75] Inventors: Naohiro Iwata, Yokosuka; Minoru Yokoyama, Yokohama; Yuji Nakano, Kawasaki; Shunji Kawashima, Wako; Hideyuki Terashima, Sagamihara, all of Japan

[73] Assignee: Canon Kabushiki Kaisha, Japan

[21] Appl. No.: 652,416

[22] Filed: May 23, 1996

[30] Foreign Application Priority Data

May 24, 1995 [JP] Japan ..... 7-124718

[51] Int. Cl.[6] ..... B65H 5/00

[52] U.S. Cl. ..... 271/10.13; 271/10.03; 271/10.05; 271/10.12

[58] Field of Search ..... 271/4.03, 4.04, 271/4.1, 10.03, 10.04, 10.05, 10.12, 10.13, 110, 242

[56] References Cited

U.S. PATENT DOCUMENTS 4,959,536 9/1990 Ijuin et al. ..... 358/461
4,975,787 12/1990 Ijuin et al. ..... 250/216
4,986,525 1/1991 Takagi et al. ..... 271/4.04
5,083,766 1/1992 Osawa ..... 271/242
5,169,136 12/1992 Yamagata et al. ..... 271/10.13
5,579,129 11/1996 Iwata et al. ..... 358/474

FOREIGN PATENT DOCUMENTS 0036132 2/1991 Japan ..... 271/242

*Primary Examiner*—H. Grant Skaggs
*Attorney, Agent, or Firm*—Fitzpatrick, Cella, Harper & Scinto

[57] ABSTRACT

The present invention provides a sheet conveying apparatus comprising a first rotary member for conveying a sheet, and a second rotary member disposed at a downstream side of the first rotary member in a sheet conveying direction and adapted to convey the sheet. It further comprises a first mode in which the first rotary member is rotated and the second rotary member is stopped, and a second mode in which the first and second rotary members are rotated. In a condition that the first rotary member is continuously rotated in one direction, the first mode is changed to the second mode.

8 Claims, 12 Drawing Sheets

SHEET CONVEYING APPARATUS

BACKGROUND OF THE INVENTION

1. Field of the Invention

The present invention relates to a sheet conveying apparatus, and more particularly, it relates to a sheet conveying apparatus suitable for application to an original conveying apparatus used with an original reading apparatus such as a facsimile and the like.

2. Related Background Art

Recently, in order to make information processing apparatuses such as facsimiles, image readers and the like compact and to improve the performance of such apparatuses, there has been proposed an elongated line sensor which can be used in the same magnification optical system as a photo-electric converter of a reading apparatus or can be used without specific optical systems. In particular, in order to achieve compactness of the apparatus, while holding down its expense, there has been proposed a reading apparatus and an information processing apparatus having such a reading apparatus, in which a photo-electric converting device directly detects the reflected light corresponding to information of an original through a transparent spacer made of glass without using the same magnification fiber lens array. Incidentally, an optical converting device of the type wherein the information is read without the interposition of any optical system is referred to as "image sensor of close contact type" hereinafter.

Now, a conventional original reading apparatus will be explained with reference to FIGS. 13 to 16. FIG. 13 is a schematic sectional view of a reading system of a facsimile in which an image sensor 108 of close contact type is used and a means for separating originals is constituted by an original separation roller 104 and a CS roller 109.

In FIG. 13, a flow of the original is as follows. When a bundle 103 of originals is inserted into an original insertion path 102 through an original insertion inlet 101, a signal is set from an original presence/absence detection sensor 115 to a control portion of the facsimile, thereby recognizing an original presence condition. The original bundle 103 is inserted until it reaches an original separation portion 106 constituted by the original separation roller 104 and an original separation piece 105 disposed in a confronting relation to the original separation roller 104 and urged against the original separation roller 104 by a biasing means (not shown).

When a start button (not shown) on an operation portion is depressed, an reading drive portion (described later) shown in FIGS. 15 and 16 is operated so that the original separation roller 104 is rotated in a direction (normal direction) to convey the original bundle 103 in a downstream direction. The original bundle is pinched between the normally rotating original separation roller 104 and the original separation piece 105, thereby separating the originals one by one. The original 103*a* separated from the original bundle 103 is conveyed by the original separation roller 104, and a tip end of the original 103*a* is detected by an original tip end detection sensor 116. When the original is further conveyed by the original separation roller 104, it reaches an image information reading portion 110 constituted by the image sensor 108 of close contact type and the CS roller 109 disposed in a confronting relation to the image sensor 108 of close contact type. The image sensor 108 of close contact type is urged against the CS roller 109 by a biasing means 111.

An image on the original 103*a* reached the image information reading portion 110 is read by the image sensor 108 of close contact type; meanwhile the original 103*a* is conveyed by the CS roller 109 rotated in the normal direction. If an original conveying speed is not constant during the reading of the original image, the image information cannot be read correctly. That is to say, in the original separation portion 106, since the original 103*a* is conveyed by a conveying force of the original separation roller 104 in opposition to a braking friction force between the original separation piece 105 and the original 103*a*, slight slip is generated between the original 103*a* and the original separation roller 104. As a result, the conveying speed of the original 103*a* becomes smaller than a peripheral speed of the original separation roller 104.

Further, the conveying speed of the originals varies in dependence upon the environment, material of the original and/or single/multi original supply, thereby not achieving the constant conveying speed. In consideration of the above, it is designed so that the original conveying speed is determined by the CS roller 109. That is to say, it is set so that the original conveying speed of the CS roller 109 is greater than the original conveying speed of the original separation roller 104, and the original conveying force of the CS roller 109 is selected to be sufficiently greater than the braking friction force between the original 103*a* and the original separation piece 105.

With the arrangement as mentioned above, the original 103*a* is conveyed at the constant speed by the CS roller 109 while the image information on the original is being read by the image sensor 108 of close contact type. After the reading operation of the image sensor 108 of close contact type, when a trail end of the original 103*a* is detected by the original tip end detection sensor 116, the original 103*a* is discharged by the CS roller 109 out of the facsimile.

As mentioned above, since the original conveying speed of the original separation roller 104 is unstable, if the reading timing is set by detecting the tip end position of the original 103*a* by means of the original tip end detection sensor 116 after the separation of the original, a conveying time during which the original 103*a* is conveyed from the original tip end detection sensor 116 to the image information reading portion 110 does not become constant, with the result that an amount of an original tip end margin will be also unstable. Further, as shown in FIG. 14, if the original 103*a* is skew-inserted for any reason, one (left in FIG. 14) of left and right tip end corners of the original 103*a* will be contacted with the CS roller 109. In this case, since the left side of the original 103*a* is conveyed by the CS roller 109, a force F1 directed in the original conveying direction acts on the original.

On the other hand, as mentioned above, since the original conveying speed of the original separation roller 104 is set to be smaller than the original conveying speed of the CS roller 109, at a central portion of the original 103*a*, a force F2 directed in a direction opposite to the original conveying direction acts on the original 103*a* due to the friction force of the original separation piece 105. Thus, a couple (couple of forces) generated by the forces F1 and F2 acts on the original 103*a*, with the result that the original is rotated in a direction shown by the arrow j. That is to say, a skew-feed of the original is promoted.

To avoid this, as shown in FIG. 15, a one-way clutch 111 is provided between a motor 110 (drive source for the reading drive system) and the CS roller 109 and a one-way clutch 112 is provided between the motor 110 and the original separation roller 104, and, regarding the combination of normal-rotation/reverse-rotation of the motor 110 and rotation/stop of the rollers 104, 109, two modes are set as follows:

| Motor normal rotation mode (10) | |
|---|---|
| motor 110 | normal rotation |
| original separation roller 104 | stop |
| CS roller 109 | normal rotation |

| Motor reverse rotation mode (11) | |
|---|---|
| motor 110 | reverse rotation |
| original separation roller 104 | normal rotation |
| CS roller 109 | stop |

Incidentally, the "normal rotation" of the original separation roller 104 and the CS roller 109 is referred to as a direction for conveying the original 103*a* toward a downstream side.

First of all, by using the motor reverse rotation mode (11), the motor 110 is rotated in the reverse direction to cause the original separation roller 104 to convey the original 103*a*, thereby abutting the tip end of the original 103*a* against the CS roller 109 (which is now stopped) to effect the registration (heading) of the original 103*a* to correct the skew-feed of the original 103*a*. Then, by using the motor normal rotation mode (10), the motor 110 is rotated in the normal direction and the original separation roller 104 is stopped, and the CS roller 109 is rotated to effect the original reading operation and the original conveying operation.

However, in the drive system as shown in FIG. 15, if the poor original conveyance of the original separation roller 104 occurs in the motor reverse rotation mode (11) for any reason so that the original 103*a* does not reach the CS roller 109, even when the motor normal rotation mode (10) is used to cause the CS roller 109 to convey the original, the original 103*a* is not conveyed, thereby causing the poor conveyance. To avoid this, as shown in FIG. 16, a second drive transmitting path 113 from the motor 110 and the original separation roller 104 and a one-way clutch 114 are added to the drive system of FIG. 15, and, regarding the combination of normal-rotation/reverse-rotation of the motor 110 and rotation/stop of the rollers 104, 109, two modes are set as follows:

| Motor normal rotation mode (12) | |
|---|---|
| motor 110 | normal rotation |
| original separation roller 104 | normal rotation |
| CS roller 109 | normal rotation |

| Motor reverse rotation mode (13) | |
|---|---|
| motor 110 | reverse rotation |
| original separation roller 104 | normal rotation |
| CS roller 109 | stop |

Incidentally, the "normal rotation" of the original separation roller 104 and the CS roller 109 is referred to as a direction for conveying the original 103*a* toward a downstream side.

First of all, by using the motor reverse rotation mode (13), the motor 110 is rotated in the reverse direction to cause the original separation roller 104 to convey the original 103*a*, thereby abutting the tip end of the original 103*a* against the CS roller 109 (which is now stopped) to effect the registration (heading) of the original 103*a* to correct the skew-feed of the original 103*a*. Then, by using the motor normal rotation mode (12), the motor 110 is rotated in the normal direction, and the original separation roller 104 and the CS roller 109 is rotated in the normal direction to effect the original reading operation and the original conveying operation.

In the above-mentioned conventional techniques, when the motor reverse rotation mode (11) is changed to the motor normal rotation mode (10) in FIG. 15, and, when the motor reverse rotation mode (13) is changed to the motor normal rotation mode (12) in FIG. 16, the motor 110 is switched from the reverse rotation to the normal rotation. Accordingly, since the motor 110 is temporarily stopped whenever the switching is effected between the reverse rotation and the normal rotation, the rotation of the original separation roller 104 is temporarily stopped whenever the switching is effected between the modes, with the result that the force directing to the conveying direction does not act on the original 103*a* temporarily. As a result, the position regulating action of the original separation roller 104 for regulating the position of the original 103*a* in the conveying direction is temporarily released, thereby causing the positional deviation of the original 103*a* in the conveying direction.

That is to say, when the motor 110 is switched between the reverse rotation and the normal rotation, the time periods during which the one-way clutches are loosened and tightened are different from each other. Thus, when the switching is effected between the modes, the rotation-start/stop-completion of the original separation roller 104 becomes unstable. As a result, for example, in the motor normal rotation mode (12), since it cannot be determined whether the original separation roller 104 or the CS roller 109 is firstly rotated, the tip end position of the original 103*a* becomes unstable, thereby not effecting the registration of the original 103*a* with high accuracy.

SUMMARY OF THE INVENTION

The present invention intends to eliminate the above-mentioned conventional drawbacks, and has as an object to provide a sheet conveying apparatus and an original reading apparatus having such a sheet conveying apparatus, in which a sheet conveyance drive system can be made compact and inexpensive and in which the sheet conveyance drive system can easily be controlled.

To achieve the above object, according to a preferred embodiment of the present invention, there is provided a sheet conveying apparatus comprising a first rotary member for conveying a sheet, and a second rotary member disposed at a downstream side of the first rotary member in a sheet conveying direction and adapted to convey the sheet. It further comprises a first mode in which the first rotary member is rotated and the second rotary member is stopped, and a second mode in which the first and second rotary members are rotated, and further, in a condition that the first rotary member is continuously rotated in one direction, the first mode is changed to the second mode.

Preferably, a registration operation for correctly positioning a tip end of the sheet is effected in the first mode and a predetermined function of a function means and sheet conveyance are effected in the second mode. Further, the first and second rotary members may be designed so that a rotational driving force of a single motor is transmitted to the first and second rotary members. Preferably, rotation/stop of the first and second rotary members is controlled by a motor normal-rotation/reverse-rotation control means, a clutch means for effecting connection/disconnection of the rotational driving force of the motor transmitted to the first rotary member in response to the switching of the normal-rotation/reverse-rotation of the motor, and a delay means for transmitting the rotational driving force of the motor to the second rotary member with predetermined time delay.

Further, the combination mode of the normal-rotation/reverse-rotation of the motor and the rotation/stop of the first and second rotary members may include a first mode in which the first rotary member is rotated and the second rotary member is stopped in the condition that the motor is rotated in the normal direction, a second mode in which the first and second rotary members are rotated in the condition that the motor is rotated in the normal direction, and a third mode in which the first and second rotary members are stopped in the condition that the motor is rotated in the reverse direction.

Further, the registration operation for correctly positioning the tip end of the sheet, the predetermined function operation of the function means effected to the conveyed sheet, and the conveyance of the sheet are performed by a sequence including a first step for providing a waiting condition, a second step for rotating the motor in the normal direction by the second mode to rotate the first and second rotary members, thereby bringing a tip end of the sheet conveyed by the first rotary member to the vicinity of the second rotary member in a sheet conveying direction, a third step for rotating the motor in the reverse direction by the third mode to accumulate or store the rotation amount of the motor in a delay means by a predetermined delay amount, a fourth step for rotating the motor in the normal direction by the first mode to rotate the first rotary member and to stop the second rotary member, thereby effecting the registration of the sheet and for maintaining the first mode until the delay amount accumulated in the delay means is discharged, and a fifth step for rotating the motor in the normal direction by the second mode to rotate the first and second rotary members, thereby effecting the predetermined function operation of the function means regarding the sheet.

Further, in the third step, the number of steps of the motor when the motor is rotated reversely is selected so that the conveying amount of the sheet conveyed by the first rotary member by rotating the motor in the normal direction by the same steps becomes greater than a distance the tip end of the sheet after the second step is finished and the second rotary member along the convey path. Further, the original reading apparatus according to the present invention has the above-mentioned sheet conveying apparatus, and the above-mentioned function means may comprise an image information reading means and the sheet may be a sheet original.

Since the sheet conveying apparatus according to the present invention has the above-mentioned construction, in the condition that the first rotary member is rotated in the sheet conveying direction to act the force directing to the sheet conveying direction on the sheet, the above-mentioned modes can be changed. Accordingly, the registration operation for registering the tip end of the sheet and the heading operation can be performed positively at the predetermined timing. Further, since the drive source for the second rotary member is constituted by the single motor, the design and control of the sheet convey drive system can be simplified and the number of parts is reduced, thereby making the apparatus more compact and cheaper.

As mentioned above, since the sheet conveying apparatus according to the present invention has the above-mentioned construction and function, the sheet can surely be conveyed. Further, an original reading apparatus having a highly accurate original heading function can be provided.

In addition, since the original reading apparatus having the sheet conveying apparatus according to the present invention as an original conveying apparatus has the above-mentioned construction and function, a highly accurate sheet heading function can be achieved, and a highly accurate registration function for effecting the registration of the sheet can be provided, and, further, the sheet convey drive system can be made compact and inexpensive, and control of the sheet convey drive system can be simplified.

DETAILED DESCRIPTION OF THE PREFERRED EMBODIMENTS

Now, an embodiment of a facsimile embodying a sheet conveying apparatus and an original reading apparatus according to the present invention will be fully explained.

Figure 1:
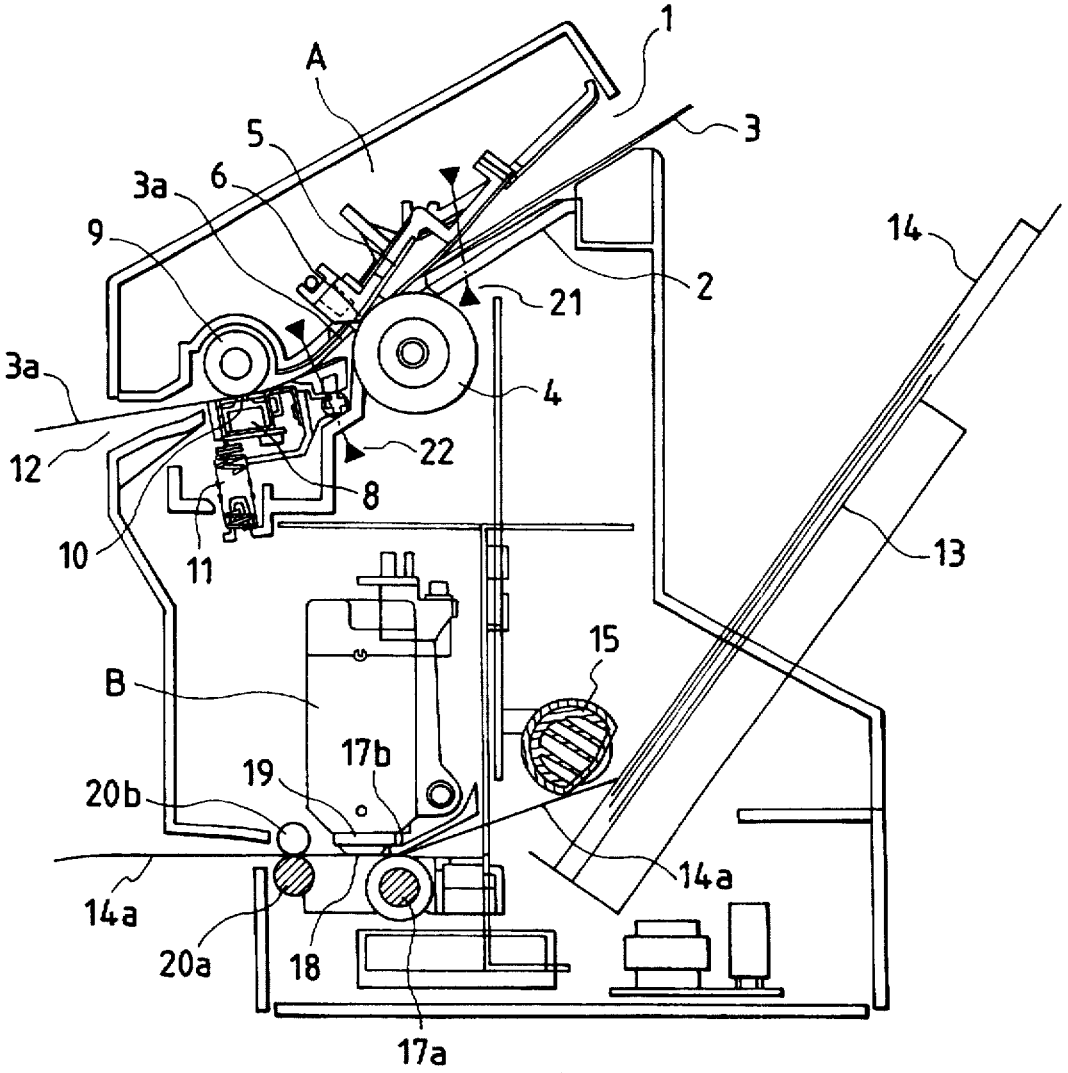
FIG. 1 is a schematic sectional view of a facsimile having an original reading apparatus according to the present invention.
Figure 2:
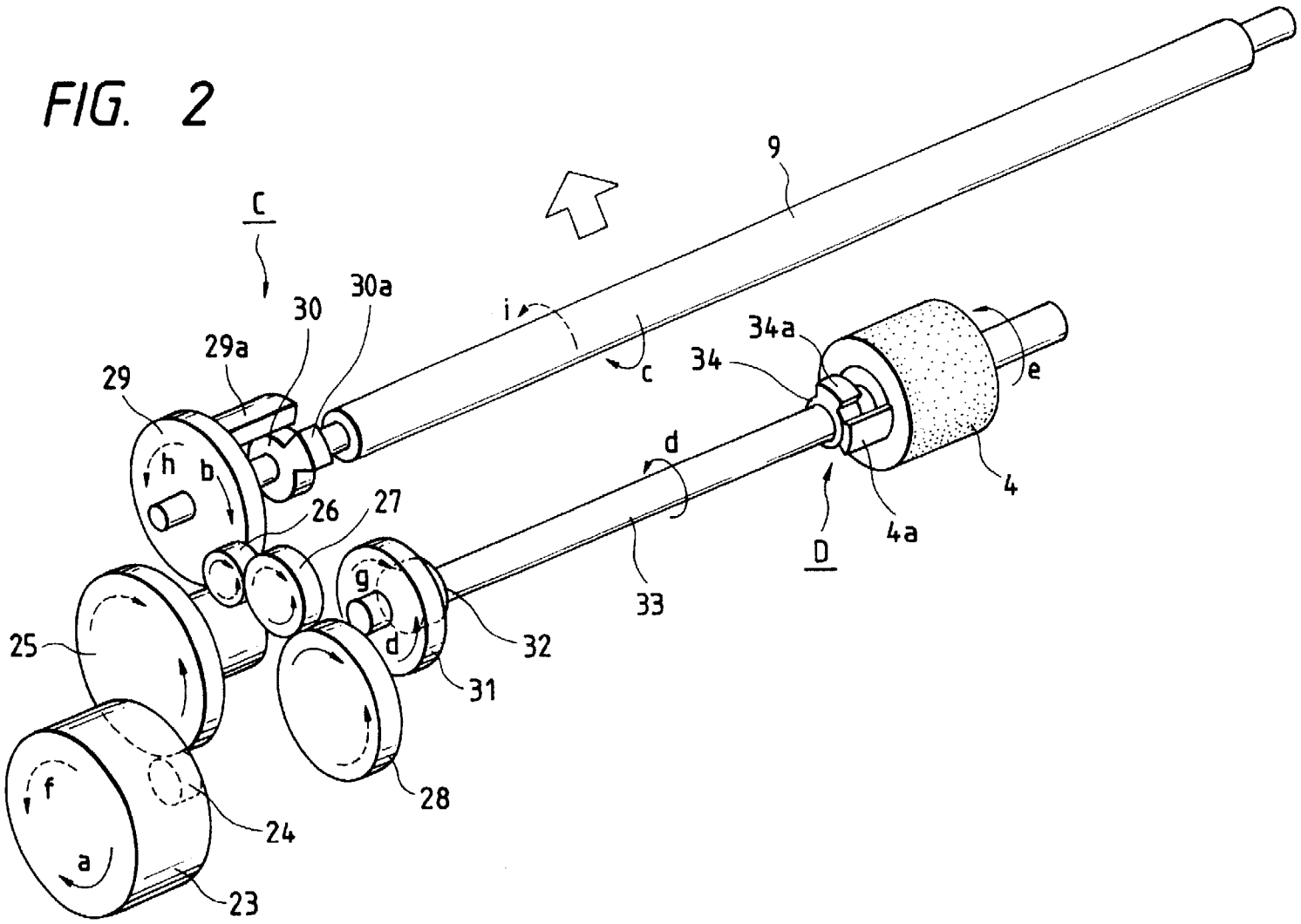
FIG. 2 is a schematic perspective view of a reading drive mechanism of the original reading apparatus according to the present invention.
Figure 10A:
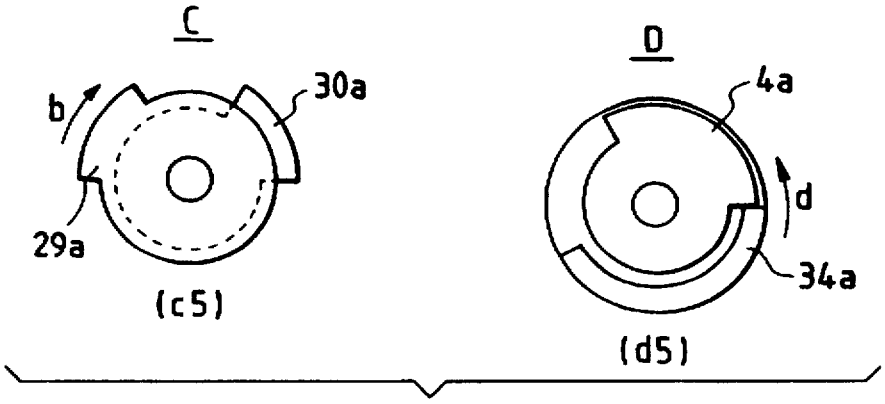
Figure 10B:
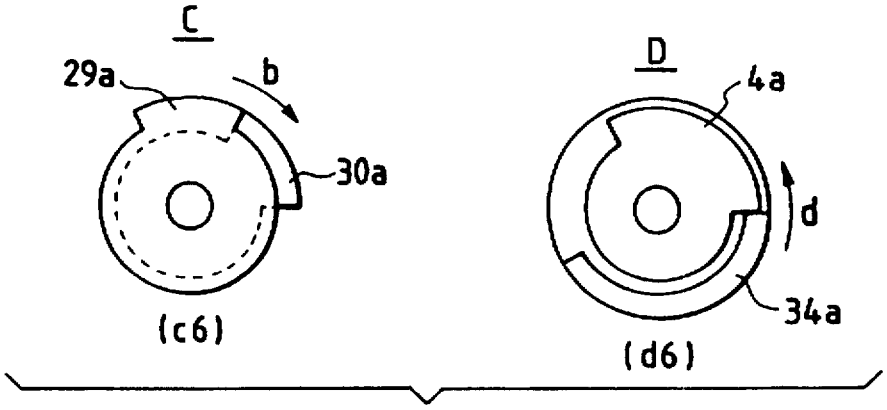
Figure 10C:
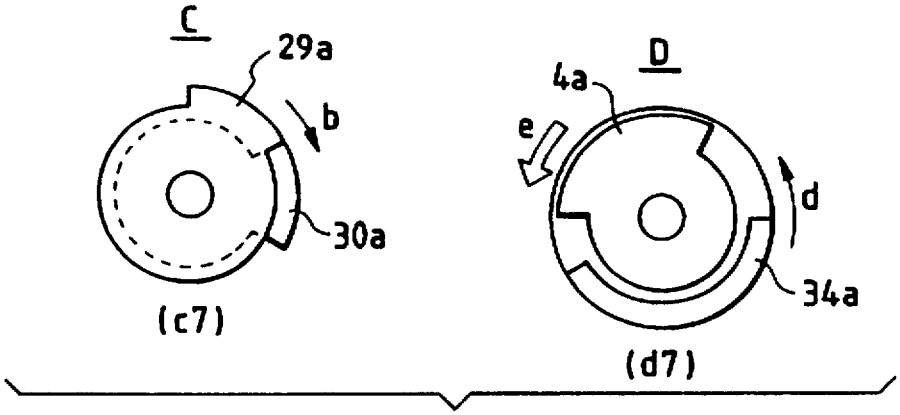
Figure 11A:
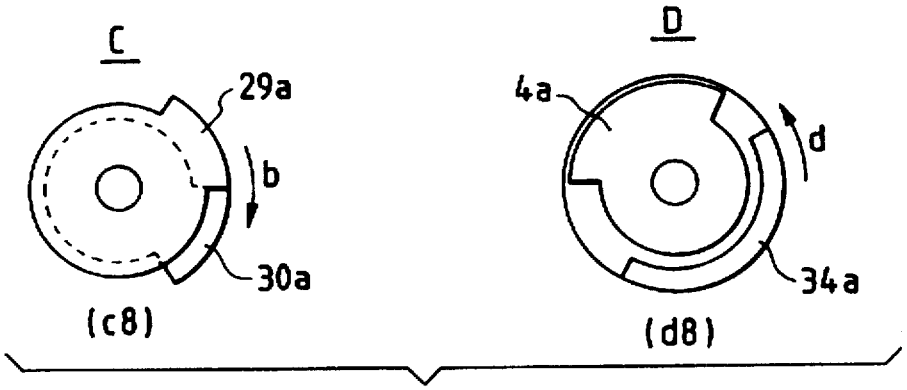
Figure 11B:
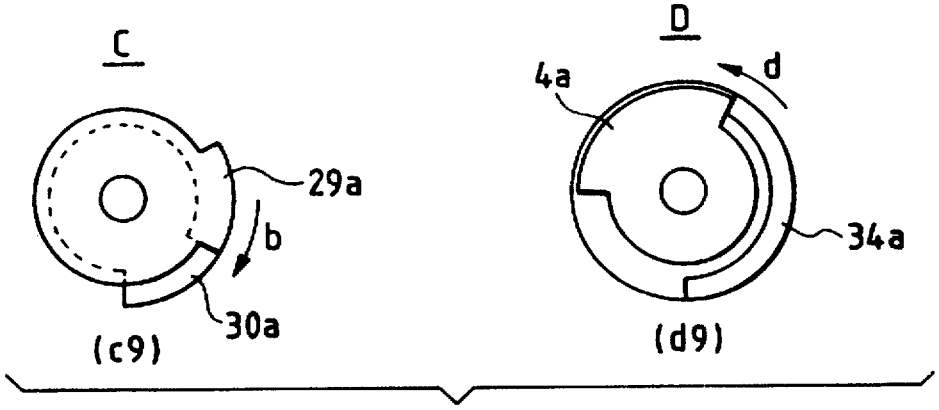
Figure 12:
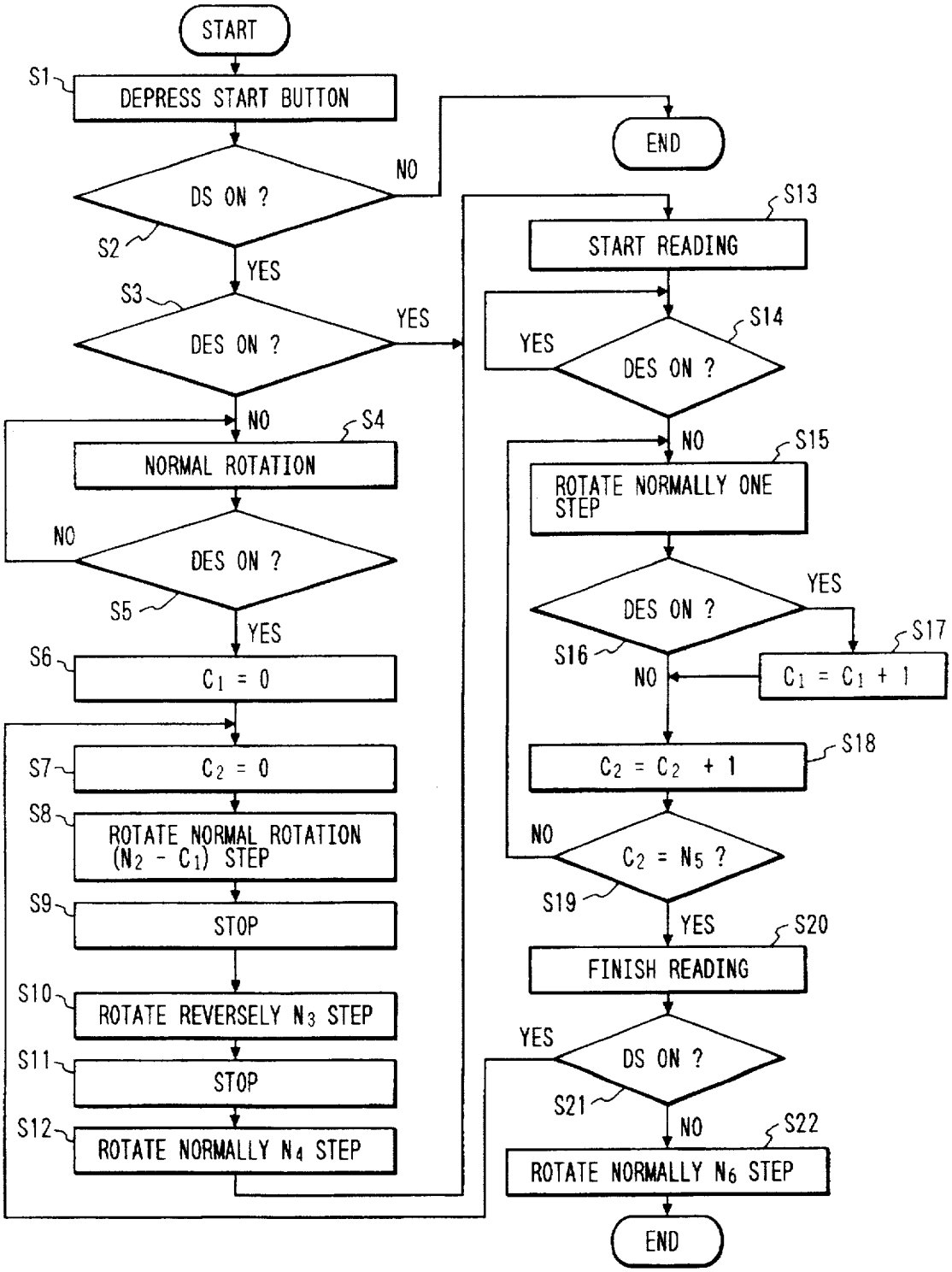
FIG. 12 is a flow chart for explaining the reading operation of the original reading apparatus.
Figure 13:
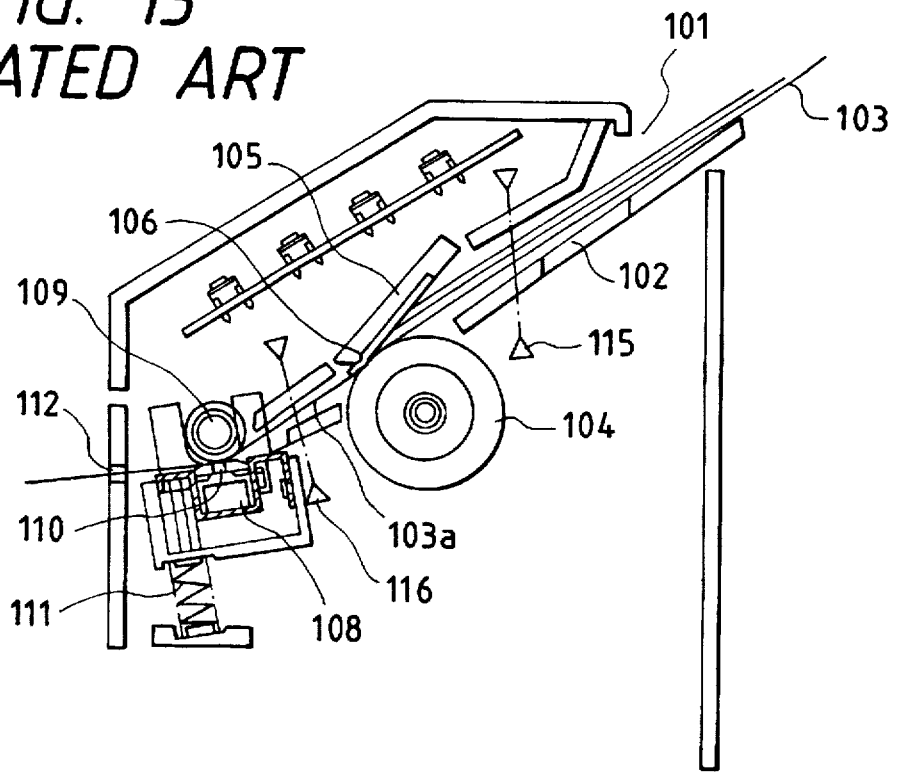
FIG. 13 RELATED ART
FIGS. 13 to 16 are views for explaining the related arts.
Figure 14:
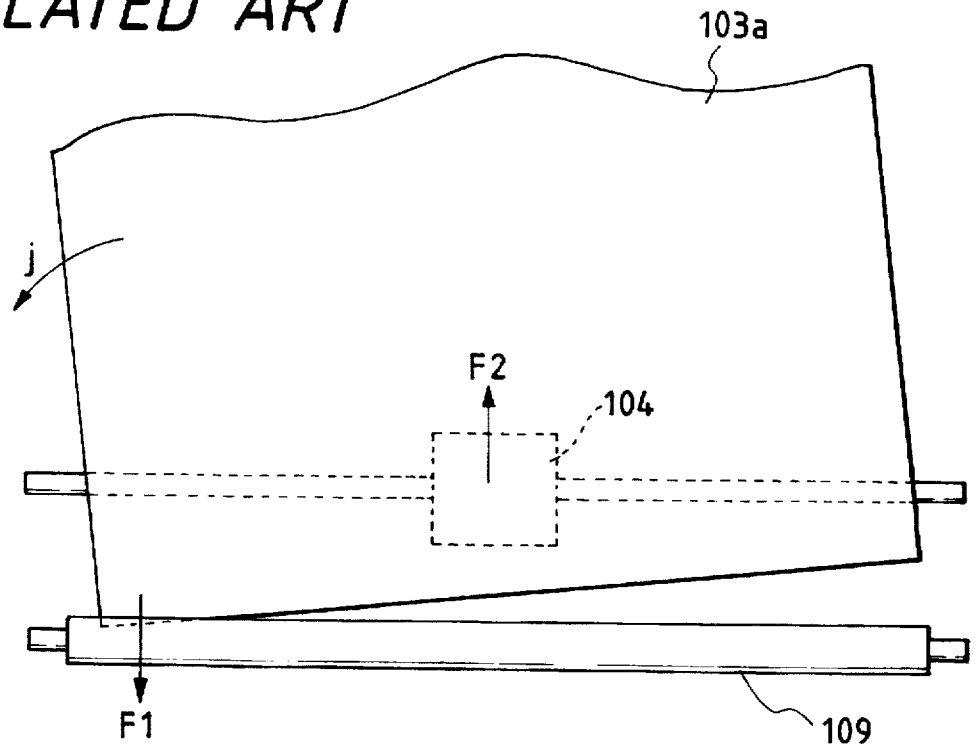
FIG. 14 RELATED ART
Figure 15:
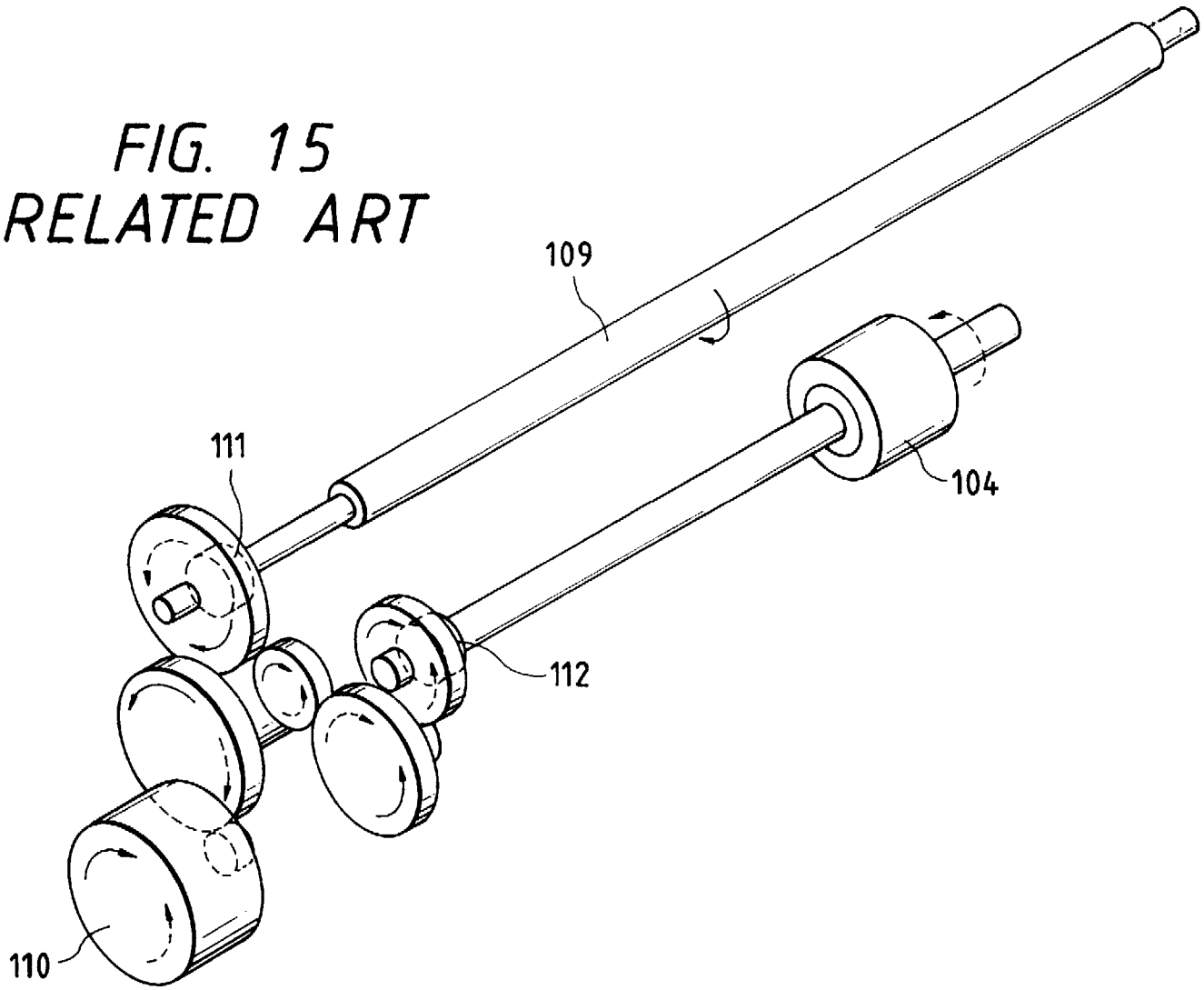
FIG. 15 RELATED ART
Figure 16:
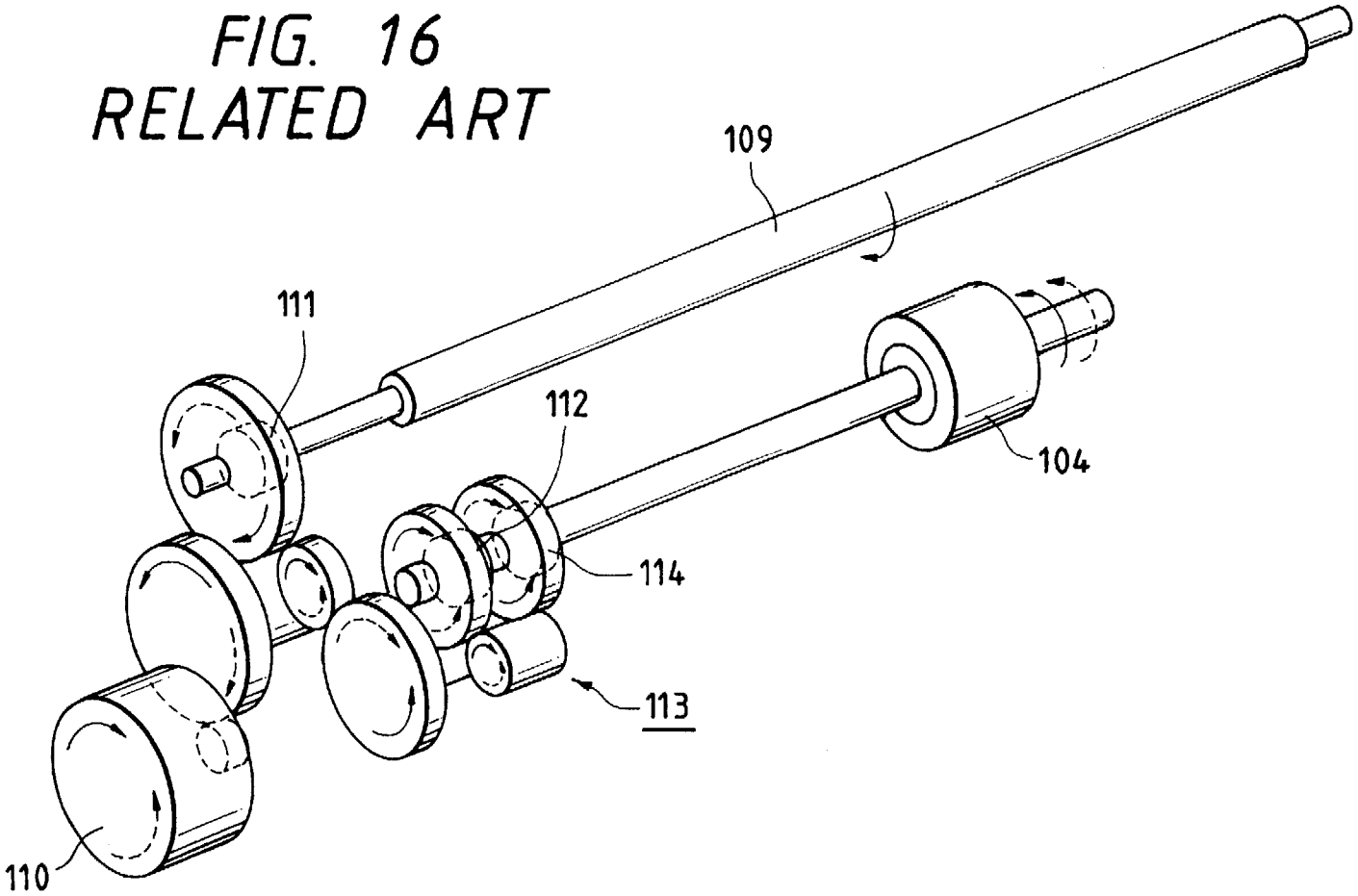
FIG. 16 RELATED ART

FIG. 1 is a schematic sectional view of a facsimile having an original reading apparatus according to the present invention, FIG. 2 is a schematic perspective view of a reading drive mechanism of the original reading apparatus according to the present invention, FIGS. 3 to 8 are views for explaining a reading operation of the original reading apparatus according to the present invention, FIGS. 9 to 11 are schematic explanatory views showing conditions of mechanical timers C and D during the reading operation of the original reading apparatus, and FIG. 12 is a flow chart for explaining the reading operation of the original reading apparatus.

In FIG. 1, the facsimile having the sheet conveying apparatus according to the present invention as an original conveying apparatus comprises an upper reading system A and a lower recording system B. First of all, a conveying flow of a sheet original (formed from a paper sheet or a synthetic resin film) in the reading system A will be explained.

When an original bundle 3 is inserted, through an original insertion inlet 1, into an original insertion path 2 inclined at an angle of 30° to 40° with respect to a horizontal plane, the original bundle 3 is detected by an original presence/absence detection sensor 21, and an original presence signal is sent to a control portion of the facsimile, thereby recognizing an original presence condition. The original bundle 3 is inserted until it reaches an original separation portion 6 constituted by an original separation roller (first rotary member) 4 and an original separation piece 5 disposed in a confronting relation to the original separation roller 4 with the interposition of an original convey path and urged against the original separation roller 4 by a biasing means such as a spring.

When a start button (not shown) on an operation portion of the facsimile is depressed, an reading drive portion (described later) shown in FIG. 2 is operated so that the original separation roller 4 is rotated in a direction (normal direction) to convey the original bundle 3 in a downstream direction. The original bundle is pinched between the normally rotating original separation roller 4 and the original separation piece 5, thereby separating the originals one by one. The original 3*a* separated from the original bundle 3 is conveyed by the original separation roller 4, and a tip end of the original 3*a* is detected by an original tip end detection sensor 22. When the original 3*a* is further conveyed by the original separation roller 4, it reaches an image information reading portion 10 constituted by an image sensor 8 of close contact type and a CS roller (second rotary member) 9 disposed in a confronting relation to the image sensor 8 of close contact type. The image sensor 8 of close contact type is urged against the CS roller 9 by a biasing means 11.

An image on the original 3*a* reaches the image information reading portion 10 is read by the image sensor 8 of close contact type; meanwhile the original 3*a* is conveyed by the CS roller 9 rotated in the normal direction. Thereafter, when a trail end of the original 3*a* is detected by the original tip end detection sensor 22, the original is discharged by the CS roller 9 out of the facsimile through an original discharge opening 12.

Next, a sheet conveying flow of a recording sheet in the recording system B will be explained. In FIG. 1, a recording sheet bundle 14 resting on a sheet stacking plate 13 is separated one by one by means of a separation roller 15. The recording sheet 14*a* separated by the separation roller 15 is conveyed to a pair of convey rollers 17*a*, 17*b* disposed in a confronting relation to each other with the interposition of a recording sheet convey path and is further conveyed by the pair of convey rollers 17*a*, 17*b* to an image recording position 18. In this position, the recording sheet is stopped temporarily and is held there.

In the image recording position 18, ink is discharged from ink discharge openings of an ink jet recording head (recording means) 19 disposed in a confronting relation to a surface (to be recorded) of the recording sheet 14*a*, thereby forming an image on the surface of the recording sheet 14*a* by adhering ink droplets to the recording sheet. After one-line recording is finished, the pair of convey rollers 17*a*, 17*b* are rotated again to convey the recording sheet 14*a*. When the recording sheet 14*a* is conveyed by a predetermined amount, the recording sheet 14*a* is stopped again, and a next one-line recording is performed in the same manner.

After one-page recording is finished by repeating the above-mentioned process, the recording sheet 14*a* is discharged out of the facsimile by means of a pair of discharge rollers 20*a*, 20*b* disposed in a confronting relation to each other with the interposition of the recording sheet convey path. In this way, the imaged recording sheets are stacked in the vicinity of a discharge opening of the facsimile.

Next, a reading operation of the original reading apparatus according to the present invention will be explained. In the illustrated embodiment, the original 3*a* is conveyed by the original separation roller 4 and the CS roller 9. At the original separation portion 6, since the lowermost original 3*a* in the original bundle 3 is conveyed by the original separation roller 4 in opposition to the braking friction force of the original separation piece 5, as is in the above-mentioned conventional technique, slight slip is caused between the original 3*a* and the original separation roller 4.

As a result, the conveying speed of the original 3*a* becomes smaller than a peripheral speed of the original separation roller 4, with the result that the conveying amounts of the originals 3*a* may be varied. Further, the conveying amounts of the originals 3*a* may be varied in dependence upon surface friction coefficient, thickness, resiliency and material of the original 3*a*, and environment such as humidity, and single sheet original supply or multi original supply. Thus, even when the tip end position of the original 3*a* is detected by means of the original tip end detection sensor 22 after the separation of the original, since a conveying time during which the original 3*a* is conveyed from the original tip end detection sensor 22 to the image information reading portion 10 is not constant, the timing for effecting the registration of the original becomes unstable, with the result that an amount of an original tip end margin will be also unstable.

In the illustrated embodiment, the timing for effecting the registration of the original is stabilized (made constant) by abutting the tip end of the original 3*a* conveyed by the original separation roller 4 against the CS roller 9 to provide the constant amount of the original tip end margin.

Further, by abutting the tip end of the original 3*a* against the CS roller 9, the skew-insertion of the original 3*a* is corrected, thereby preventing the skew-feed of the original. This operation is referred to as "registration operation" hereinafter. In order to perform the registration operation, regarding the combination of normal-rotation/reverse-rotation of a motor 23 (described later) shown in FIG. 2 and rotation/stop of the rollers 4, 9, at least three modes are set as follows:

| Motor normal rotation mode (1) [First mode] | |
|---|---|
| motor 23 | normal rotation |
| original separation roller 4 | normal rotation |
| CS roller 9 | stop |

| Motor normal rotation mode (2) [Second mode] | |
|---|---|
| motor 23 | normal rotation |
| original separation roller 4 | normal rotation |
| CS roller 9 | normal rotation |

| Motor reverse rotation mode (3) [Third mode] | |
|---|---|
| motor 23 | reverse rotation |
| original separation roller 4 | stop |
| CS roller 9 | stop |

Incidentally, the "normal direction" of the original separation roller 4 and the CS roller 9 is referred to as a direction for conveying the original 3*a* toward a downstream side.

Next, the reading drive system of the original reading apparatus will be explained. In FIG. 2, the reference numeral 4 denotes the original separation roller; 9 denotes the CS roller; 23 denotes a reversible stepping motor acting as a drive source; and 24 denotes an output gear for the stepping motor 23. The reference numeral 25 denotes a speed change gear rotatably supported by a stud and meshed with the output gear 24; 26, 27 denote transmission gears rotatably supported by studs and meshed with the speed change gear 25; and 28 denotes a speed change gear rotatably supported by a stud and meshed with the transmission gear 27. The reference numeral 29 denotes a CS roller output gear meshed with the speed change gear 25 and rotatable with respect to a shaft of the CS roller 9; 30 denotes a CS roller output member rotated together with the CS roller 9.

The CS roller output gear 29 constituting a part of a mechanical timer (delay means) C for transmitting a rotational driving force of the motor 23 to the CS roller 9 with predetermined time delay has a projection 29*a* protruding toward a direction parallel with the axis of the CS roller 9, and the CS roller output member 30 has a projection 30*a* protruding toward a radial direction of the CS roller 9. When the rotational driving force of the motor 23 is transmitted to the CS roller output gear 29 through the output gear 24 and the speed change gear 25 to rotate the CS roller output gear 29, the projection 29*a* of the CS roller output gear 29 is separated from or contacted with the projection 30*a* of the CS roller output member 30. If the projections 29*a*, 30*a* are separated from each other, a rotational driving force of the CS roller output gear 29 is not transmitted to the CS roller output member 30, with the result that the CS roller 9 is not rotated. On the other hand, if the projections 29*a*, 30*a* are contacted with each other, the rotational driving force of the CS roller output gear 29 is transmitted to the CS roller output member 30, thereby rotating the CS roller 9.

That is to say, when the CS roller output gear 29 is rotated in a predetermined direction, the CS roller 9 is not rotated and held stationary while the projection 29*a* of the CS roller output gear 29 is separated from the projection 30*a* of the CS roller output member 30. When the projection 29*a* of the CS roller output gear 29 is contacted with the projection 30*a* of the CS roller output member 30, the CS roller 9 starts to rotate in the same direction as the CS roller output gear 29. A delay means for transmitting the rotational driving force of the motor 23 with predetermined time delay is referred to as "mechanical timer mechanism" hereinafter.

An original separation roller output gear 31 meshed with the speed change gear 28 includes a clutch means 32 therein. The clutch means 32 serves to permit (connect) or inhibit (disconnect) the transmission of the rotational driving force of the motor 23 transmitted through the output gear 24, speed change gear 25, transmission gears 26, 27, speed change gear 28 and original separation roller output gear 31, in response to the normal rotation or the reverse rotation of the motor 23. That is to say, when the motor 23 is rotated in the normal direction, the rotational driving force of the motor 23 is transmitted to a shaft 33 of the original separation roller 4, thereby rotating the original separation roller shaft 33. On the other hand, when the motor 23 is rotated in the reverse direction, the rotational driving force of the motor 23 is disconnected or interrupted, with the result that the rotational driving force is not transmitted to the original separation roller shaft 33, thereby holding the original separation roller shaft 33 stationary.

In a mechanical timer (delay means) D for transmitting the rotational driving force of the motor 23 to the original separation roller 4 with predetermined time delay, the original separation roller 4 having a projection 4*a* disposed at a predetermined position and protruding toward a direction parallel with the original separation roller shaft 33 is rotatable with respect to the original separation roller shaft 33, and an original separation roller output member 34 having a projection 34*a* protruding toward a radial direction of the original separation roller shaft 33 is rotated together with the original separation roller shaft 33. When the projection 4*a* of the original separation roller 4 is contacted with the projection 34*a* of the original separation roller output member 34, the mechanical timer mechanism similar to the above is operated between the original separation roller 4 and the original separation roller output member 34.

Next, an operation of the reading drive system having the above-mentioned construction will be explained. In FIG. 2, when the motor 23 is rotated in the normal direction shown by the arrow a, the CS roller output gear 29 is rotated in a direction shown by the arrow b in FIG. 2 through the output gear 24 and the speed change gear 25. Consequently, the projection 29*a* of the CS roller output gear 29 is contacted with the projection 30*a* of the CS roller output member 30, with the result that the CS roller 9 is rotated in the normal direction shown by the arrow c in FIG. 2 to convey the original 3*a* in the downstream direction.

In this case, the original separation roller output gear 31 is rotated in a direction shown by the arrow d in FIG. 2 through the output gear 24, speed change gear 25, transmission gears 26, 27 and speed change gear 28. Due to the connecting action of the clutch means 32, the rotational driving force of the motor 23 in the normal direction is transmitted to the original separation roller shaft 33, with the result that, when the projection 34*a* of the original separation roller output member 34 is engaged by the projection 4*a* of the original separation roller 4, the original separation roller 4 is rotated in the normal direction shown by the arrow e in FIG. 2 to convey the original 3*a* toward the downstream direction. The above-mentioned rotational direction of the reading drive system is referred to as "normal direction" hereinafter.

On the other hand, when the stepping motor 23 is rotated in a direction shown by the broken line arrow f in FIG. 2, the original separation roller output gear 31 is rotated in a direction shown by the broken line arrow g in FIG. 2 through the output gear 24, speed change gear 25, transmission gears 26, 27 and speed change gear 28. In this case, due to the disconnection action of the clutch means 32, the rotational driving force of the motor 23 in the reverse direction is not transmitted to the original separation roller shaft 33, thereby holding the original separation roller 4 stationary.

In this case, the CS roller output gear 29 is rotated in a direction shown by the broken line arrow h in FIG. 2 through the output gear 24 and the speed change gear 25. While the projection 29*a* of the CS roller output gear 29 is separated from the projection 30 of the CS roller output member 30, the CS roller 9 is not rotated to be kept stationary. When the projection 29*a* is contacted with the projection 30*a*, the CS roller 0 is rotated in the reverse direction shown by the broken line arrow i in FIG. 2 to return the original 3*a*. The above-mentioned rotational direction of the reading drive system is referred to as "reverse direction" hereinafter.

Next, an original reading sequence will be explained with reference to FIGS. 3 to 8, and operations of the mechanical timer mechanisms C, D will be explained with reference to FIGS. 9 to 11. Incidentally, {(c1), (d1)} to {(c9), (d9)} shown in FIGS. 9 to 11 show conditions of the mechanical timer mechanisms C, D at the same timing, and {(c)} group shows the conditions of the mechanical timer mechanism C and {(d)} group shows the conditions of the mechanical timer mechanism D.

Figure 3:
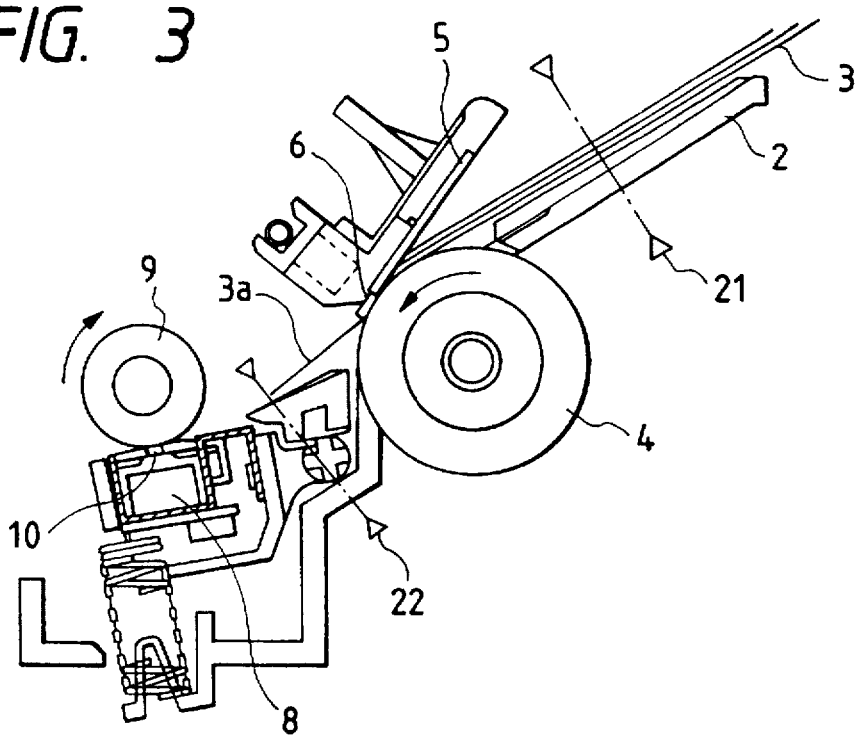
FIGS. 3 to 8 are views for explaining a reading operation of the original reading apparatus according to the present invention.

First of all, as shown in FIG. 3, the original bundle 3 is inserted to reach the original separation portion 6. When the start button (not shown) on the operation portion is depressed, the stepping motor 23 is rotated in the normal direction. In this case, as shown in (c1) of FIG. 9, when the projection 29*a* of the CS roller output gear 29 is separated from the projection 30*a* of the CS roller output member 30, the CS roller 9 is not rotated. On the other hand, as shown in (c2) of FIG. 9, when the projection 29*a* of the CS roller output gear 29 is contacted with the projection 30*a* of the CS roller output member 30, the CS roller 9 is rotated in the normal direction (original conveying direction) as shown in FIG. 3.

In this case, as shown in (d1) of FIG. 9, when the projection 29*a* of the original separation roller output member 34 is separated from the projection 4*a* of the original separation roller 4, the original separation roller 4 is not rotated. On the other hand, as shown in (d2) of FIG. 9, when the projection 34*a* of the original separation roller output member 34 is contacted with the projection 4*a* of the original separation roller 4, the original separation roller 4 is rotated in the normal direction (original conveying direction) as shown in FIG. 3, thereby separating and conveying the lowermost original 3*a*.

Figure 4:
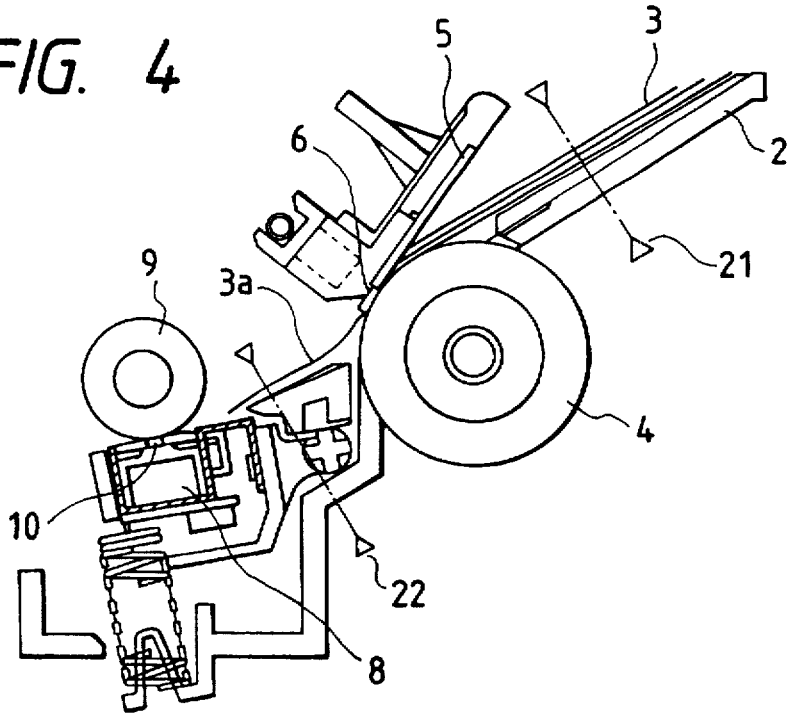

When the stepping motor 23 is rotated in the normal direction by the predetermined number of steps after the tip end of the original 3*a* is detected by the original tip end detection sensor 22, the motor 23 is stopped. In this case, as shown in FIG. 4, the predetermined number of steps is selected so that the tip end of the original 3*a* is stopped in front of the CS roller 9.

Then, when the stepping motor 23 is rotated in the reverse direction, due to the disconnecting action of the clutch means 32, the rotational driving force of the motor 23 is not transmitted to the original separation roller 4, and, thus, the original separation roller 4 is held stationary as shown in (d3) of FIG. 9. On the other hand, as shown in (c3) of FIG. 9, regarding the CS roller 9, the mechanical timer mechanism C is operated for the predetermined time period during which the CS roller is held stationary.

After the stepping motor 23 is rotated in the normal direction by the predetermined number of steps, the motor 23 is stopped. In this case, the mechanical timer mechanism C between the projection 29*a* of the CS roller output gear 29 and the projection 30*a* of the CS roller output member 30 is set so that, as shown in (c4) of FIG. 9, the stepping motor 23 is stopped before the projection 29*a* of the CS roller output gear 29 is contacted with the projection 30*a* of the CS roller output member 30, thereby still holding the CS roller 9 stationary.

Then, the stepping motor 23 is rotated in the normal direction again. In this case, the clutch means 32 provides the connecting action, and, in the mechanical timer mechanism D, as shown in (d3) and (d4) of FIG. 9, the projection 34*a* of the original separation roller output member 34 is maintained to be contacted with the projection 4*a* of the original separation roller 4, so that, substantially at the same time when the normal rotation of the stepping motor 23 is started, the original separation roller 4 is rotated in the normal direction, thereby conveying the original 3*a*. On the other hand, as shown in (c5) of FIG. 10, the mechanical timer mechanism C is operated regarding the CS roller 9, with the result that the CS roller is not rotated and kept stationary for the predetermined time period. Meanwhile, the skew-feed of the original 3*a* is corrected and the registration of the original is performed.

Figure 5:
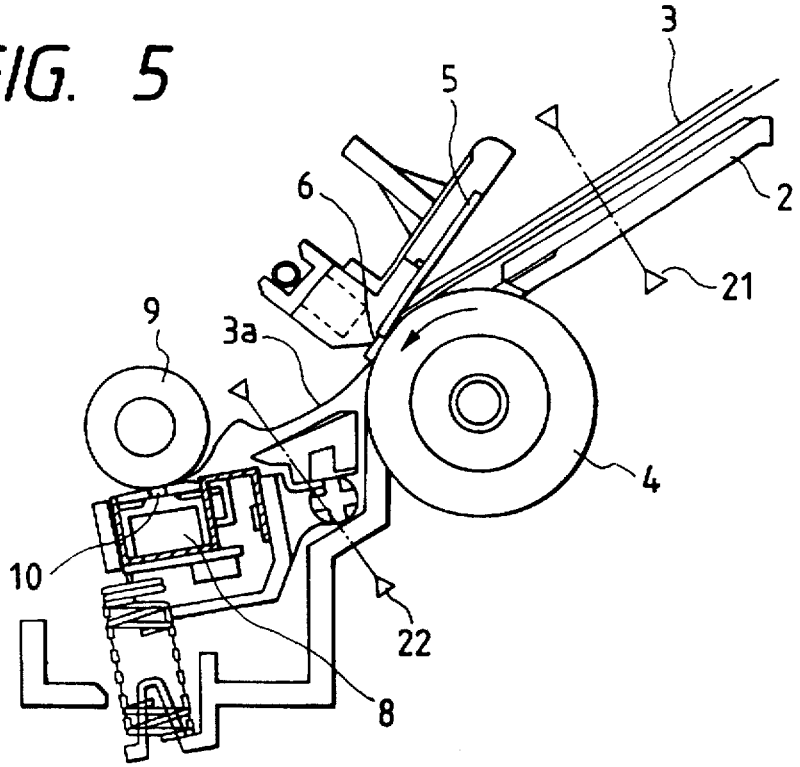

That is to say, in the case where the original 3*a* has relatively small resiliency, the tip end of the original abuts against the stopped CS roller 9, and then, the original separation roller 4 is rotated in the normal direction to convey the original 3*a*. Consequently, as shown in FIG. 5, a loop is formed in a tip end portion of the original 3*a* at an upstream side of the CS roller 9, with the result that the skew-feed of the original is corrected by the resiliency of the original 3*a* itself.

On the other hand, in the case where the original 3*a* has relatively great resiliency, after the tip end of the original abuts against the stopped CS roller 9, the original separation roller 4 is further rotated in the normal direction to afford the conveying force to the original 3*a*. Consequently, at the original separation portion 6, slip is generated between the original 3*a* and the original separation roller 4, thereby correcting the skew-feed of the original 3*a*. Now, the correction of the skew-feed of the original 3*a* will be further explained. If the original 3*a* is obliquely inserted into the original insertion path 2, one of front tip end corners (for example, left end corner) of the original 3*a* firstly abuts against the CS roller 9.

In this case, as mentioned above, since the CS roller 9 is stopped, the left tip end corner of the original 3*a* cannot be further advanced. In this condition, by further rotating the original separation roller 4 in the normal direction to afford the conveying force to the original 3*a*, at the original separation portion 6, the slip is generated between the original 3*a* and the original separation roller 4, thereby correcting the skew-feed of the original 3*a*. Meanwhile, only the right tip end corner of the original (which does not yet abut against the CS roller 9) is conveyed toward the downstream direction.

As a result, the entire front edge of the original 3*a* abut against the stopped CS roller, thereby completing the correction of the skew-feed of the original 3*a*. The correction of the skew-feed of the original 3*a* is performed in a condition that the delaying action of the mechanical timer mechanism C is effected and the delaying action of the mechanical timer mechanism D is not effected (that is, the projection 34*a* of the original separation roller output member 34 is contacted with the projection 4*a* of the original separation roller 4) as shown in (c5) and (d5) of FIG. 10. At this timing, the skew-feed of any original available to the facsimile is completed. Incidentally, even if the slip is not generated between the original and the roller 4, since the loop is formed in the original, the skew-feed of the original can be corrected. In this case, the skew of the original is absorbed by the loop.

Then, when the stepping motor 23 is rotated in the normal direction by the predetermined number of steps, as shown in (c6) of FIG. 10, the delaying action of the mechanical timer mechanism C is finished, with the result that the projection 29*a* of the CS roller output gear 29 abuts against the projection 30*a* of the CS roller output member 30, thereby rotating the CS roller 9 in the normal direction. In this case, as shown in (d6) of FIG. 10, in the mechanical timer mechanism D, the projection 34*a* of the original separation roller output member 34 is still contacted with the projection 4*a* of the original separation roller 4 to continuously rotate the original separation roller 4 in the normal direction.

The stepping motor 23 is further rotated in the normal direction by the predetermined number of steps, thereby starting the image information reading operation. When the normal rotation of the CS roller 9 is started, since the original 3*a* is pinched between the CS roller 9 and the image sensor 8 of close contact type, the registration of the original 3*a* can be maintained constantly at this timing.

Further, in the present invention, the change from the motor normal rotation mode (1) or first mode in which the original separation roller 4 is rotated in the normal direction and the CS roller 9 is stopped as shown in (c5) and (d5) of FIG. 10 to the motor normal rotation mode (2) or second mode in which the original separation roller 4 and the CS roller 9 are rotated in the normal direction as shown in (c6) and (d6) of FIG. 10 differs from the conventional technique. That is to say, unlike in the conventional technique in which the rotational direction of the motor is changed from the normal direction to the reverse direction, in a condition that the motor 23 is continuously rotated in the normal direction and the original separation roller 4 is continuously rotated in the normal direction to continuously afford the conveying force to the original 3*a*, the mode (1) can be changed to the mode (2). Accordingly, unlike in the conventional technique, since the registration of the original does not become unstable due to the interruption of the conveying force, the highly accurate registration of the original can be achieved.

Further, as mentioned above, since the skew-feed of the original 3*a* is corrected, when the original 3*a* is pinched between the CS roller 9 and the image sensor 8 of close contact type, the conveying force of the CS roller 9 acts on the original 3*a* through the entire area of the original in a direction (referred to as "width-wise direction" hereinafter) perpendicular to the original conveying direction. Accordingly, the braking frictional force between the original separation piece 5 and the original 3*a* and the conveying force acting on the original from the CS roller 9 do not generate couple of forces (unlike to the conventional case), thereby preventing the skew of the original 3*a*.

The stepping motor 23 is further rotated in the normal direction, and, as shown in (c7) and (d7) of FIG. 10, the original separation roller 4 and the CS roller 9 are continuously rotated in the normal direction to convey the original 3*a*. In this case, since the conveying amount of the original 3*a* (conveying speed) provided by the CS roller 9 is selected to be greater than the conveying amount of the original 3*a* (conveying speed) provided by the original separation roller 4, the original separation roller 4 is rotated by the movement of the original 3*a* conveyed by the CS roller 9. Therefore, the original separation roller 4 is rotated faster than the original separation roller output member 34. As a result, in the mechanical timer mechanism D, as shown in (d7) of FIG. 10, the projection 4*a* of the original separation roller 4 is gradually separated from the projection 34*a* of the original separation roller output member 34.

Figure 6:
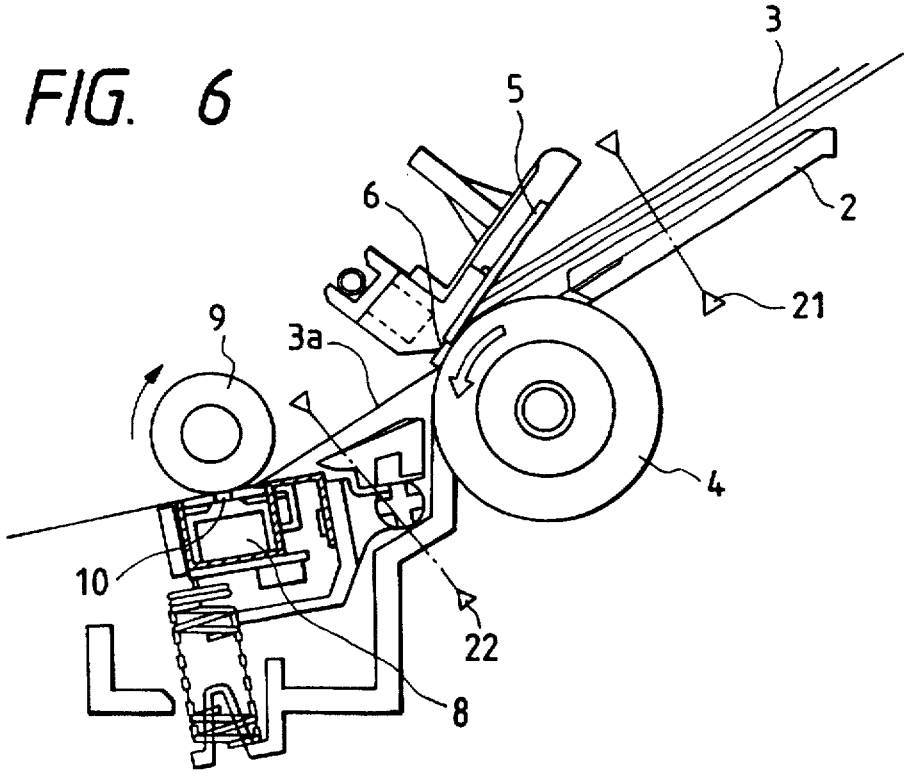

As shown in FIG. 6, when the original 3*a* is conveyed while being contacted with the image sensor 8 of close contact type, in the image information reading portion 10, the image information on the original 3*a* is read by the image sensor 8 of close contact type.

As mentioned above, the reading drive system is designed so that the original conveying speed of the CS roller 9 becomes greater than the original conveying speed of the original separation roller 4, and the biasing forces acting on the image sensor 8 of close contact type and the original separation piece 5 are adjusted so that the original conveying force of the CS roller 9 becomes greater than the braking friction force of the original separation piece 5. Accordingly, the conveying speed of the original 3*a* in the image information reading portion 10 is determined by the conveying speed of the CS roller 9. Thus, as shown in FIG. 6, when the original 3*a* is being conveyed by both of the original separation roller 4 and the CS roller 9, regarding the original separation portion 6, the original 3*a* is conveyed while being pulled by the CS roller 9 toward the downstream direction.

Figure 7:
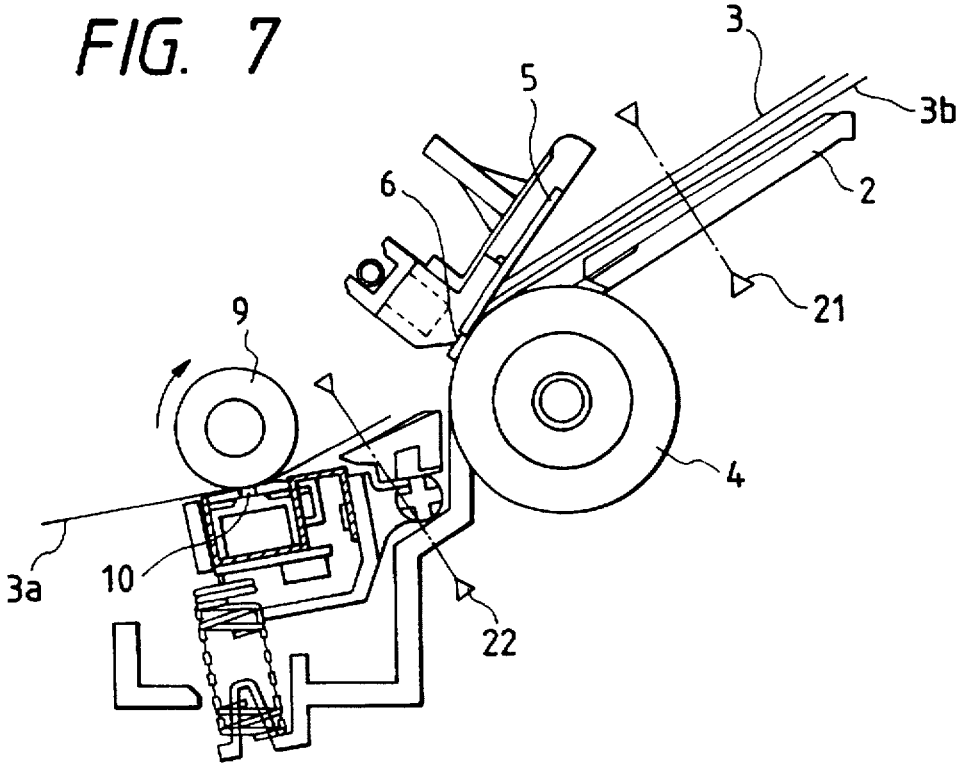

The stepping motor 23 further continues to rotate in the normal direction. As shown in FIG. 7, when the trail end of the original 3*a* leaves the original separation portion 6, the movement of the original separation roller 4 driven by the CS roller 9 is released. In this case, since the mechanical timer mechanism D acts on the original separation roller 4 as shown in (d8) of FIG. 11, the original separation roller 4 is not rotated and held stationary for a while. Thus, a succeeding original 3*b* is not conveyed by the movement of the original 3*a*. On the other hand, as shown in (c6) of FIG. 10 to (c8) of FIG. 11, the CS roller 9 is still rotated continuously in the normal direction, with the result that the original 3*a* is further conveyed toward the downstream direction by the CS roller 9.

After a predetermined time period is elapsed, when the projection 34*a* of the original separation roller member 34 abuts against the projection 4*a* of the original separation roller 4 as shown in (d9) of FIG. 11, the original separation roller 4 start to rotate. In this case, since the original 3*a* was conveyed toward the downstream direction by a predetermined amount, a proper distance (sheet-to-sheet distance) between the original 3*a* and the succeeding original 3*a* can be ensured. Accordingly, the original tip end detection sensor 22 can surely detect the preceding original 3*a* and the succeeding original 3*b* independently.

In FIG. 7, when the trail end of the original 3*a* is detected by the original tip end detection sensor 22, the stepping motor 23 is rotated by the predetermined number of steps. At this point, the image information reading operation of the image sensor 8 of close contact type is finished. The stepping motor 23 is further rotated in the normal direction, with the result that the original 3*a* in which the image information was read is discharged out of the facsimile through the original discharge opening 12.

The stepping motor 23 is further rotated in the normal direction, with the result that the succeeding original 3*a* is conveyed by the original separation roller 4 until the succeeding original 3*a* is stopped in front of the CS roller 9 (similar to the preceding original 3*a* shown in FIG. 3). In this case, the mechanical timer mechanism D between the projection 34*a* of the original separation roller output member 34 and the projection 4*a* of the original separation roller 4 is designed so that the first original 3*a* was surely discharged out of the facsimile when the second original 3*b* is stopped.

Figure 8:
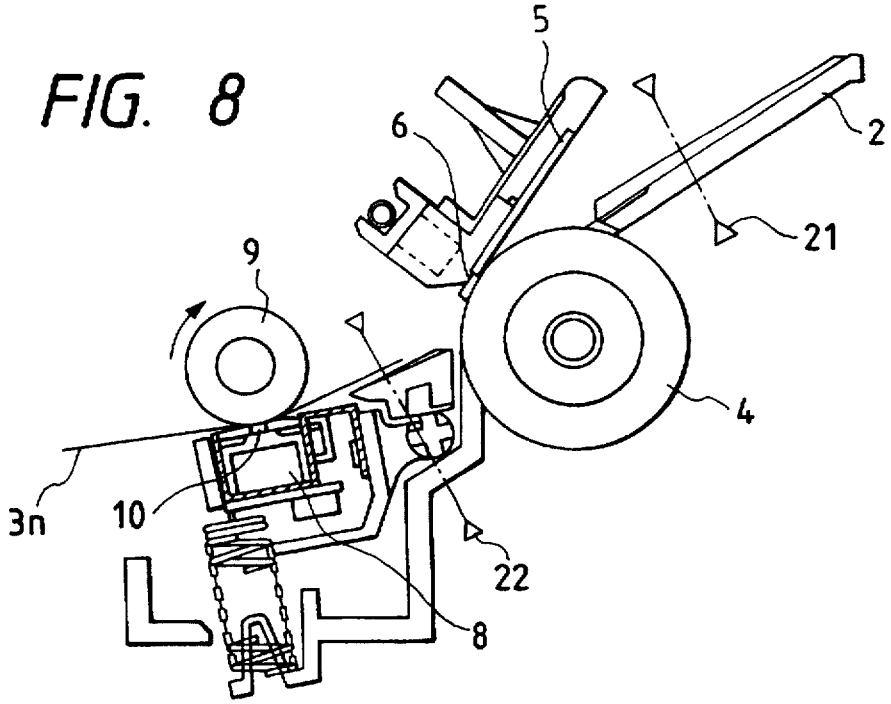
Figure 9A:
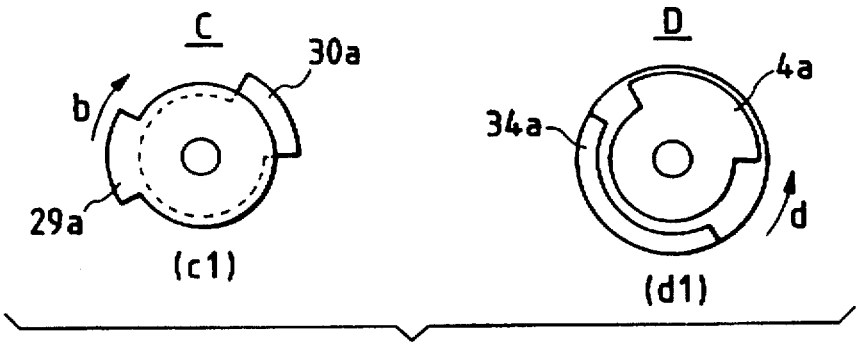
FIGS. 9A–D, 10A–C and 11A–B are schematic explanatory views showing conditions of mechanical timers C and D during the reading operation of the original reading apparatus.
Figure 9B:
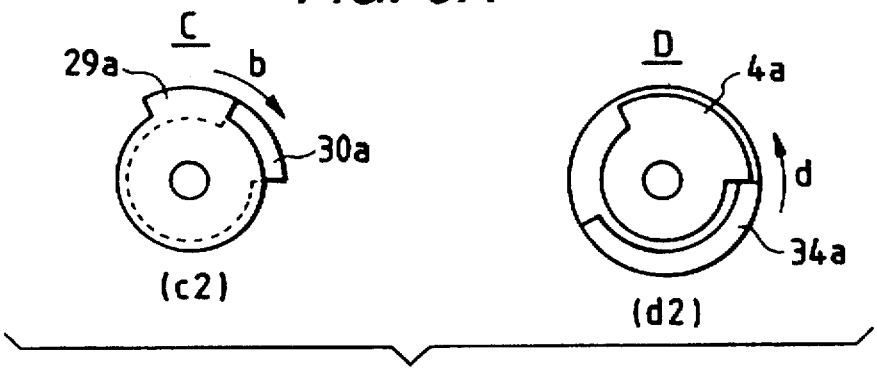
Figure 9C:
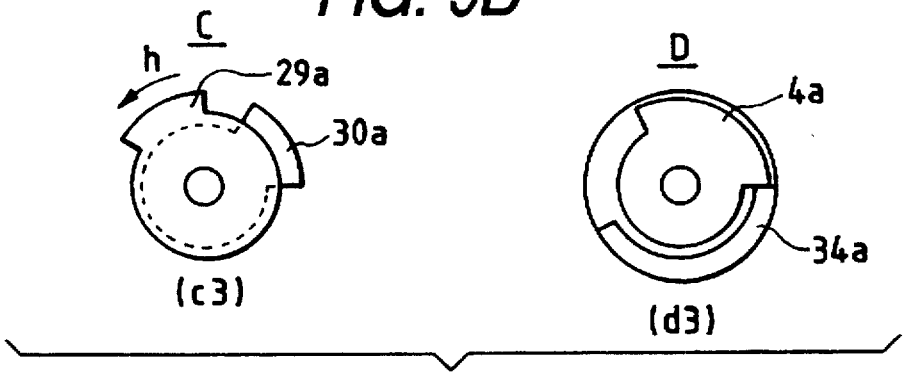
Figure 9D:
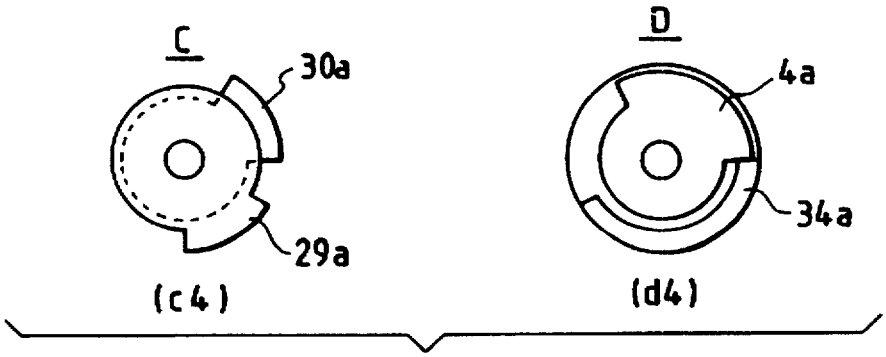

Thereafter, by repeating the operations shown in FIGS. 3 to 7, the originals are successively separated from the original bundle 3 and the image information of the separated original is read. At last, as shown in FIG. 8, when the absence of the original in the original insertion path 2 is detected by the original presence/absence sensor 21 and a trail end of a last original 3*n* is detected by the original tip end detection sensor 22, after the stepping motor 23 is rotated in the normal direction by the predetermined number of steps, the image information reading operation is stopped. The stepping motor 23 is further rotated in the normal direction until the last original 3*n* is discharged out of the facsimile. In this way, a series of image information reading operations are completed, and the facsimile is returned to a waiting condition.

Next, a flow chart regarding the image information reading operation will be explained with reference to FIG. 12. In FIG. 12, first of all, when the image reading start button of the image reading apparatus is depressed (step S1), in a step S2, it is judged whether the original presence/absence detection sensor DS (document S) 21 (referred to merely as "DS" hereinafter) is turned ON, i.e., whether the original 3*a* exists in the original insertion path 2.

If the DS is turned OFF, it is judged that the original 3*a* does not exist in the original insertion path 2 and the image information reading operation is finished. On the other hand, in the step S2, if the DS is turned ON, it is judged that the original 3*a* exists in the original insertion path 2, and the program goes to a step S3. In the step S3, it is judged whether the original tip end detection sensor DES (document edge sensor) 22 (referred to merely as "DES" hereinafter) is turned ON. If the DES is turned ON, it is judged that the original is introduced into the reading convey path, and the program goes to a step S13, where the reading operation is started.

On the other hand, in the step S3, if the DES is turned OFF, it is judged that the original 3*a* is waiting at the proper position, and the program goes to a step S4, where the motor 23 is rotated in the normal direction to further convey the original 3*a* toward the downstream direction. Then, in a step S5, it is judged whether the DES is turned ON for recognizing the tip end position of the original. If the DES is turned OFF, the program is returned to the step S4, where the motor 23 is further rotated in the normal direction. The routine comprised of the steps S4 and S5 is repeated until the tip end of the original 3*a* is detected by the DES. In the step S5, when the DES is turned ON, in a next step S6, 0 is inputted in a counter C1 provided in the control portion of the facsimile, and then, in a step S7, 0 is inputted in a counter C2.

Then, in a step S8, the motor 23 is rotated in the normal direction by the number of steps corresponding to a value obtained by subtracting the number of steps inputted in the counter C1 from the predetermined number N2 of steps for the stepping motor 23. That is to say, in case of the first original 3*a*, since the value of the counter C1 is 0, the motor 23 is rotated in the normal direction by the predetermined number N2 of steps.

Then, in a step S9, the motor 23 is stopped, and then, in a step S10, the motor 23 is rotated in the reverse direction by the predetermined number N3 of steps. Then, in a step S11, the motor 23 is stopped. Thereafter, in a step S12, the motor 23 is rotated in the normal direction by the predetermined number N4 of steps. Then, in the step S13, the image information reading operation is started.

Next, in a step S14, it is judged whether the DES is turned ON for recognizing the trail end position of the original 3*a*. If the DES is turned ON, it is judged that the trail end of the original 3*a* is positioned at the upstream side of the DES, and the image information reading operation is continued. In the step S14, when the DES is turned OFF, it is judged that the trail end of the original 3*a* has passed through the DES, and, in a step S15, the motor 23 is rotated in the normal direction by one step, and then, in a step S16, it is judged whether the DES is turned ON. If the DES is turned ON, in a next step S17, the value inputted in the counter C1 is increased by one increment. On the other hand, if the DES is turned OFF, the value inputted in the counter C1 remains as it is.

Next, in a step S18, the value inputted in the counter C2 is increased by one increment. Then, in a step S19, it is judged whether the value inputted in the counter C2 is equal to the predetermined number N5 of steps. If not equal, the program is returned to the step S15, and, the routine comprised of the steps S15 to S19 is repeated until the value inputted in the counter C2 becomes equal to the predetermined number N5 of steps.

In the step S19, when the value inputted in the counter C2 becomes equal to the predetermined number N5 of steps, the number of steps after the DES is turned OFF in the step S17 (i.e. the number of steps after the tip end of the second original 3*b* has just passed through the DES) has been inputted in the counter C1. Then, in a step S20, the image information reading operation for the first original 3*a* is finished.

Next, in a step S21, it is judged whether the DS is turned ON. If the DS is turned OFF, it is judged that there is not succeeding original, and then, in a step S22, the motor 23 is rotated in the normal direction by the predetermined number N6 of steps to discharge the first original 3*a*. In this way, the program is ended. On the other hand, in the step S21, if the DS is turned ON, it is judged that there is any succeeding original, and, the program is returned to the step S7, where 0 is inputted to the counter C2. Then, as is in the first original, the motor 23 is rotated in the normal direction by the number of steps corresponding to the value obtained by subtracting the number of steps inputted in the counter C1 from the predetermined number N2 of steps.

When the image information reading operation for the first original is finished, since the second original 3*b* has already been advanced by the number of steps inputted to the counter C1, by rotating the motor 23 in the normal direction by the number (N2–C1) of steps, the tip end of the second original 3*b* has been passed through the DES by the number N2 of steps, which is the same as the number of steps regarding the previous first original 3*a*. Thereafter, the same operations as mentioned above are repeated.

By repeating the routine comprised of the steps S7 to S21, the reading operation for all of the originals are performed. When the reading operation for the last original 3*n* is finished, in the step S22, the motor 23 is rotated in the normal direction by the number N6 of steps to discharge the last original 3*n*, and the program is ended.

Incidentally, the clutch means 32 for connecting for disconnecting the transmission of the driving force in accordance with the rotational directions of the stepping motor 23 shown in the illustrated embodiment may comprise a spring clutch means, a needle clutch means, a rocking gear train clutch means or the like. Further, in the illustrated embodiment, while an example that the sheet conveying apparatus according to the present invention is applied to the original reading apparatus was explained, for example, the present invention can be applied to an image forming apparatus having a recording means as a function means (for performing a predetermined function) disposed at a downstream side of the first rotary member in the sheet conveying direction.

What is claimed is:

1. A sheet conveying apparatus comprising:

a first rotary member for conveying a sheet;

a second rotary member disposed at a down-stream side of said first rotary member in a sheet conveying direction for conveying the sheet;

a single motor;

first transmission means for transmitting a force of said single motor to said first rotary member, said first transmission means being provided with clutch means for effecting connection/disconnection of the force to said first rotary member and first delay means for delaying transmission of the force, said clutch means including a rotary member rotatable about a shaft, said first delay means including a first pair of engagement portions between which play can be formed;

second transmission means for transmitting the force of said single motor to said second rotary member and provided with second delay means including a second pair of engagement portions between which play can be formed, wherein:

(1) in a first step, said clutch means is connected by normal rotation of said single motor to rotate said first rotary member for conveying the sheet;

(2) in a second step, said single motor is rotated reversely when a tip end of the sheet is located between said first and second rotary members, to disconnect said clutch means thereby not to rotate one of the first paired engagement portions and not to form the play therebetween but to thereby rotate one of the second paired engagement portions and to form the play therebetween;

(3) in a third step, said single motor is rotated normally to connect said clutch means to thereby rotate said first rotary member for conveying the sheet through the first paired engagement portions between which no play is formed, but to thereby not rotate said second rotary member until the play formed in the second paired engagement portions is canceled, so that the tip end of the sheet conveyed by said first rotary member is abutted against said second rotary member, and (4) in a fourth step, said single motor continues the normal rotation to cancel the play in the second paired engagement portions to thereby rotate said second rotary member for conveying the sheet.

2. A sheet conveying apparatus according to claim 1, wherein said second rotary member has larger conveying amount than said first rotary member so that, when said second rotary member starts the rotation, said first rotary member followingly rotates with said first rotary member to form the play in the first pair of engagement portions.

3. A sheet conveying apparatus according to claim 2, wherein said second rotary member is a feed member for feeding the sheet to a reading portion, and the reading is started after execution of predetermined steps after said second rotary member starts rotation thereof.

4. A sheet conveying apparatus according to claim 3, wherein when a trail end of the sheet passes by said first rotary member, said first rotary member is released from the following rotation to stop the rotation thereof and continues stoppage until the play at the first paired engagement portions is canceled.

5. A sheet conveying apparatus according to claim 4, wherein when the play in the first engagement portions is canceled, said first rotary member starts the rotation to start conveyance of the next sheet.

6. A sheet conveying apparatus according to claim 5, wherein said first rotary member is a roller separating one sheet from plural sheet s and conveying the separated one sheet.

7. A sheet conveying apparatus according to claim 1, wherein said first rotary member is a roller separating one sheet from a bottom of a sheet stack and conveying it, and said second rotary member is a roller contacting with the sheet above a reading platen and conveying it.

8. A sheet conveying apparatus according to claim 1, further comprising a sensor for detecting that a tip end of the sheet has passed downstream of said first rotary member.

* * * * *

UNITED STATES PATENT AND TRADEMARK OFFICE

CERTIFICATE OF CORRECTION

PATENT NO. :5,749,570

DATED : May 12,1998

INVENTOR(S) : Naohiro Iwata et al.

It is certified that error appears in the above-identified patent and that said Letters Patent is hereby corrected as shown below:

On the title page:

[73] ASSIGNEE

"Canon Kabushiki Kaisha, Japan" should read --Canon Kabushiki Kaisha, Tokyo, Japan--.

COLUMN 4

Line 22, "directing to" should read --directed to--.

Line 38, "firstly" should read --first--.

COLUMN 7

Line 8, "an" should read --a--.

COLUMN 14

Line 16, "start" should read --starts--.

UNITED STATES PATENT AND TRADEMARK OFFICE

CERTIFICATE OF CORRECTION

PATENT NO. :5,749,570

DATED :May 12,1998

INVENTOR(S) :Naohiro Iwata et al.

It is certified that error appears in the above-identified patent and that said Letters Patent is hereby corrected as shown below:

COLUMN 18

Line 19, "sheet s" should read --sheets--.

Signed and Sealed this

Twenty-fifth Day of May, 1999

*Attest:*

Q. TODD DICKINSON

*Attesting Officer*

*Acting Commissioner of Patents and Trademarks*